United States Patent [19]

Maykemper et al.

[11] 4,313,698

[45] Feb. 2, 1982

[54] HYDRAULIC SHIELD-TYPE SUPPORT

[75] Inventors: Alfred Maykemper; Gerhard Schorradt; Günter Werth, all of Wuppertal, Fed. Rep. of Germany

[73] Assignee: Hermann Hemscheidt Maschinenfabrik GmbH & Co., Wuppertal, Fed. Rep. of Germany

[21] Appl. No.: 119,186

[22] Filed: Feb. 6, 1980

[30] Foreign Application Priority Data

Feb. 7, 1979 [DE] Fed. Rep. of Germany ..... 2904544

[51] Int. Cl.[3] ..... E21D 23/00

[52] U.S. Cl. ..... 405/296; 405/299

[58] Field of Search ..... 405/291, 295, 296, 297, 405/299, 300; 299/31, 33

[56] References Cited

U.S. PATENT DOCUMENTS 4,028,898 6/1977 Blumenthal et al. ..... 405/299
4,048,804 9/1977 Elsner et al. ..... 405/295
4,147,459 4/1979 Koppers ..... 405/291 X

FOREIGN PATENT DOCUMENTS 982024 2/1965 United Kingdom ..... 405/291
1027584 4/1966 United Kingdom ..... 405/291
1222204 2/1971 United Kingdom ..... 405/291

*Primary Examiner*—David H. Corbin
*Attorney, Agent, or Firm*—Berman, Aisenberg & Platt

[57] ABSTRACT

The invention is concerned with a hydraulic shield-type support for supporting roofs in mines comprising a pair of base slides between which is located a channel-section guide beam supporting an hydraulic ram. At the rear end of the hydraulic ram a yoke is pivotally connected at a central part thereof to the rear end of the guide beam, the two outer portions of the yoke being pivotally connected to the rear end portions of the base slides. The front extendable end of the ram is connected to an elongate flat tongue which is longitudinally slidable in the guide beam underneath the hydraulic ram.

4 Claims, 3 Drawing Figures

HYDRAULIC SHIELD-TYPE SUPPORT

This invention relates to hydraulic shield-type supports for supporting roofs in mines, especially coal-mines.

In German Published Patent Application No. 26 44 999 there is described a hydraulic shield-type mine-roof support comprising two base slides which are movable relatively to one another in a vertical direction and which form a pedestal for hydraulic vertically-adjustable props, a roof-engaging plate or other structure which is pivoted near its back-filling end to an obliquely-disposed shield guided in a vertically pivotable manner by control levers pivotably connecting the rear portion of the shield to the base slides, and a hydraulic driving ram disposed between the base slides. One end of the driving ram of the support is connectable to a cross-member connecting the base slides on the working face side, while the other end of the driving ram is connectable at the back-filling side via a transverse yoke to a guide linkage which, in turn, at the working-face side, is connected to a conveyor, driving beam or the like.

The force of the driving ram required for moving the support forwards is transmitted to the base slides via the cross-member on the working-face side. If, during the advance of the support, one of the base slides moves over an uneven part of the mine floor, the result (owing to the pivoting connection of the control levers to the shield and the base slides) will be a lifting motion of that base slide relatively to the other slide and a simultaneous forward motion. The said cross-member must therefore be constructed to follow the complicated motion of the base slides in two directions, since otherwise the driving ram will be loaded by unacceptably-high transverse forces. However, the structure required for making this possible is relatively expensive and takes up too much space. In particular, as the cross-member and its associated structure is disposed in the working-face region of the base slides where the travelling-road usually is, the road is considerably obstructed as a result. It is therefore necessary, particularly in thin seams, to move the drive ram further into the support, thus reducing the total length of the support.

In order to shorten the total length of the driving mechanism and allow the driving ram to move further into the support, it has been proposed to mount the drive ram on a swivel mounting at one side on a base slide of the support, a bridge interconnecting the two base slides, serving only, in this case, to guide the base slides parallel to one another—see German Published Patent Application No. 26 44 614. This drive mechanism, however, has the disadvantage that the driving force exerted on only one base slide is now transmitted to the adjacent base slide via the shield and the above-mentioned control levers. As a result, the adjacent base slide is subjected to a component of force directed towards the floor of the mine which presses the tip of the latter slide into the floor.

The main object of the present invention, therefore, is to provide a drive mechanism which does not obstruct the travelling-road in the front region of the support and which transmits the force of the driving ram to both base slides substantially equally.

With this object in view, the invention is directed to a hydraulic shield-type mine roof support comprising a pair of adjacent base slides adapted to slide along the floor of a mine, at least one hydraulic prop pivotally connected at a lower end thereof to said base slides, at least two control levers pivotally connected at lower ends thereof to said base slides, a shield pivotally connected to upper ends of said control levers whereby the shield can be lifted and lowered with respect to said base slides, a mine-roof engaging structure pivotally attached to an upper portion of said shield, a driving ram adapted to act at both ends and disposed between said base slides, means including an inspection platform connected to an extendable part of said ram for the purpose, in operation of the apparatus, of connecting said ram to a conveyor at the working face of a mine, a guide beam located between said base slides and arranged to support said driving ram, a transverse connecting yoke pivotably interconnecting said base slides at the rear ends thereof, means connecting an outer cylinder of the driving ram to said guide beam, and means connecting said extendable part of said ram to an elongate tongue longitudinally guided by said guide beam and connected to said inspection platform.

An example of a mine-roof support in accordance with the invention is shown in the accompanying drawings, in which.

Figure 1:
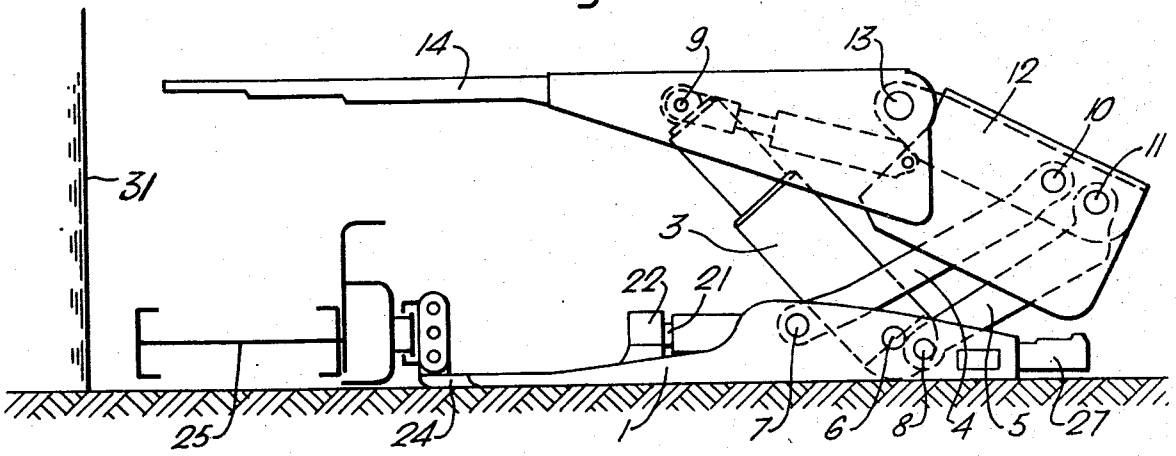
FIG. 1 is a side view of the support, shown diagrammatically.
Figure 3:
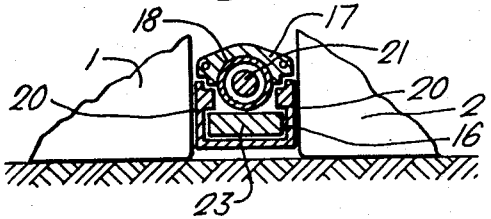
FIG. 3 is a section taken on the line III—III in FIG. 2.

The mine-roof support shown in the drawings comprises a pair of base slides 1, 2 which lie alongside each other and are shaped to slide over the floor of a mine. Pivotally connected to the base slides is at least one hydraulic prop 3 and at least two control levers 4 and 5, the lower end of the prop 3 being connected to the base slides by the pivot means 6, and the lower ends of the levers 4 and 5 being connected to the base slides by the pivot means 7, 8. The upper ends of the levers 4, 5 are pivotally connected at 10 and 11 respectively to a shield 12 which can, by expansion and contraction of the prop 3, be raised and lowered with respect to the base slides 1, 2. At its upper end, the shield 12 pivotally supports at 13 a roof-engaging plate or other such structure 14 to which the upper end of the prop 3 is pivotally connected at 9. The face of the mine is shown at 31 in FIG. 1.

Figure 2:
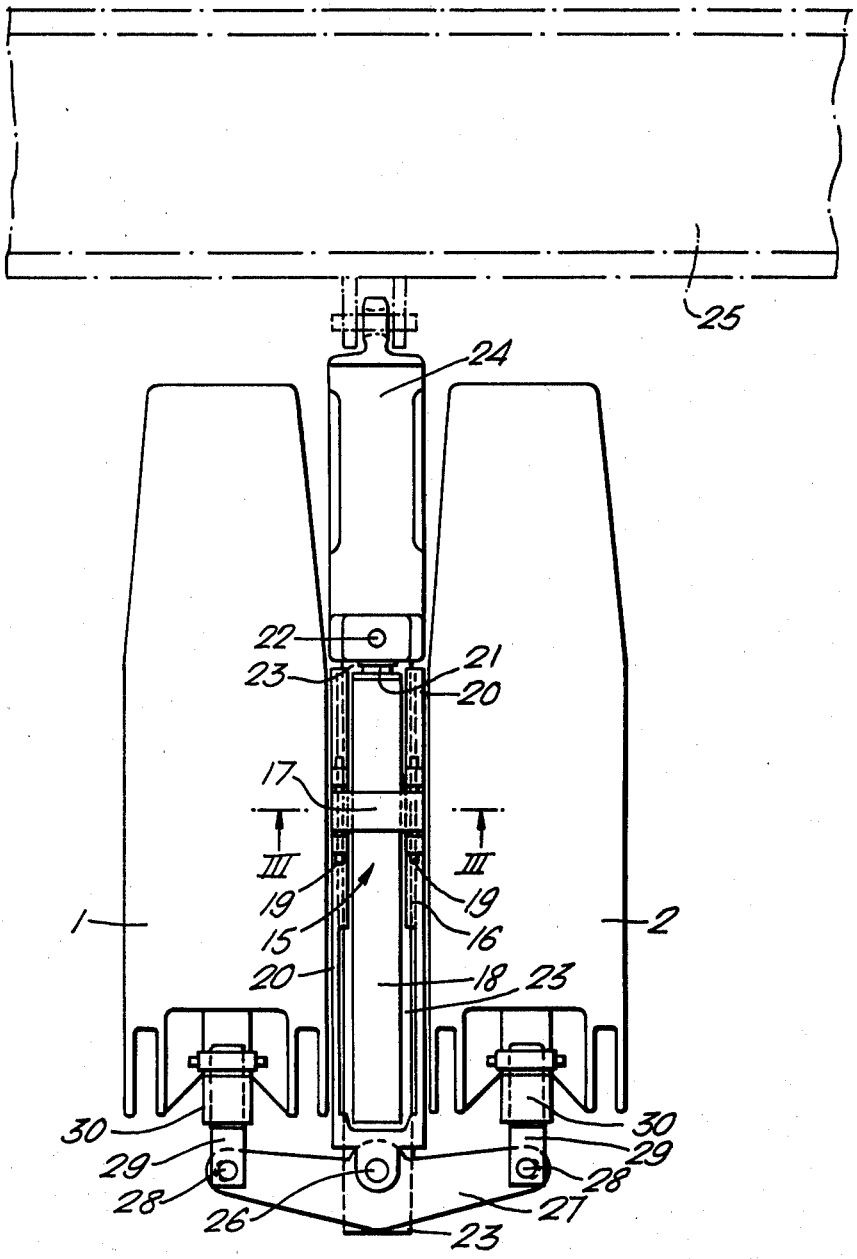
FIG. 2 is an enlarged plan view from above of the base slides and drive mechanism forming part of the support shown in FIG. 1.

A hydraulic driving ram 15 which can act at both ends is disposed between the base slides 1, 2 in a channel-section guide beam 16 which is closed towards the floor of the mine. The ram 15 is secured to the beam 16 by a retaining stirrup 17 which is disposed on the upper surface of the outer cylinder 18 of the ram 15 and which is secured by cotter pins 19 to the side walls 20 of the beam 16. The free end of the extendable inner cylinder 21 of the ram points towards the working-face 15 and is connected to an upwardly-projecting bracket 22 of an elongate tongue 23 which is longitudinally guided under the ram 15 in the beam 16. The tongue 23 has a flat rectangular cross-section (see FIG. 2) and is guided over its entire length in the beam when the ram 15 is fully retracted. At the working-face side, the tongue extends from the ram abutment formed by the bracket 22 into a flat inspection platform 24 which can move over the floor and is connected in turn to a conveyor, driving beam of like transporting means 25 (shown only diagrammatically in the drawings) disposed at the working-face 31.

At the back-filling side of the support, a vertical link pin 26 in the rear part of the beam 16 or in the ram 15 is pivotally connected to a transverse yoke 27 which is constructed like a balance beam and interconnects the base slides 1 and 2 on the back-filling side (i.e. at the rear portions of those slides) and forms an abutment for the ram 15 at that side. The slides 1 and 2 are each connected to the outer portions of the transverse yoke 27 by pivot pins 28 and hinge joint pins 29 extending along the longitudinal axes of the slides 1, 2 respectively. The pins 29 are therefore coupled at one end to the transverse yoke 27 by the vertical pivot pins 28 and are rotatably secured at their other ends in respective bearing housings 30 pivotally located at the back-filling ends of the base slides 1 and 2.

It will thus be seen that the two base slides of the support are interconnected at the back-filling side by the drive mechanism and are guided, in parallel, substantially by means of the control levers 4, 5. The force of the driving ram 15 is transmitted to both slides 1, 2 substantially uniformly and equally, i.e. without transverse forces, via the transverse yoke 27 and the hinge joint pins 27 disposed in the longitudinal axes of the slides 1, 2. The pivot connections 26,28,29 also allow the slides to move relatively to one another. By means of the base slides 1, 2, the driving forces are also uniformly transmitted to the other components of the support.

During an advance of the support, the driving ram 15 mounted in the guide beam 16 and connected to the movable tongue 23 therein is completely relieved from transverse forces. Further, the driving mechanism as a whole is very compact and stable, and takes up only a little space in the support, particularly as the working-face end of the tongue 23 guided in the guide beam 16 leads into an inspection platform guided flat along the mine floor between the forward portions of the base slides 1,2. As a result, even in very thin seams, those forwards portions can extend up to the conveyor 25 without reducing the width required for travelling in the longwall face.

We claim:

1. A hydraulic shield-type mine-roof support comprising a pair of adjacent base slides adapted to slide along the floor of a mine, at least one hydraulic prop pivotally connected at a lower end thereof to said base slides, at least two control levers pivotally connected at lower ends thereof to said base slides, a shield pivotally connected to upper ends of said control levers whereby the shield can be lifted and lowered with respect to said base slides, a mine-roof engaging structure pivotally attached to an upper portion of said shield, a driving ram adapted to act at both ends and disposed between said base slides, means including an inspection platform connected to an extendable part of said ram for the purpose, in operation of the apparatus, of connecting said ram to a conveyor at the working face of a mine, a channel-section guide beam located between said base slides and arranged to support said driving ram, a transverse connecting yoke pivotably interconnecting said base slides at the rear ends thereof to permit relative movement between said base slides both longitudinally and vertically, means connecting an outer cylinder of the driving ram to said guide beam, means coupling said transverse yoke to the rear end portion of said guide beam by at least one substantially vertical pivot pin, and means connecting said extendable part of said ram to an elongate tongue longitudinally guided by said guide beam within the channel thereof, below said driving ram, and connected to said inspection platform.

2. A mine-roof support as claimed in claim 1, wherein the channel of said guide beam is open at its upper side and partially receives the driving ram.

3. A mine-roof support as claimed in claim 1, wherein said means connecting the outer cylinder of the ram to the guide beam comprise a stirrup which bridges the channel in the guide beam.

4. A mine-roof support as claimed in claim 1, wherein said substantially vertical pivot pin coupling said transverse yoke to the guide beam is located at a central portion of said yoke, and wherein the outer portions of said yoke are pivotally connected to the respective base slides through longitudinally-extending hinge joint pins, each pin being secured so that it can rotate about its longitudinal axis in a respective bearing housing disposed at the rear end of the respective base slide.

* * * * *